US007980403B2

(12) United States Patent
Martinez

(10) Patent No.: US 7,980,403 B2
(45) Date of Patent: Jul. 19, 2011

(54) CONTAINER CLOSURE WITH INTERNAL THREADING SYSTEM

(75) Inventor: Ray Martinez, Barrington, IL (US)

(73) Assignee: Stokely-Van Camp, Inc., Chicago, IL (US)

( * ) Notice: Subject to any disclaimer, the term of this patent is extended or adjusted under 35 U.S.C. 154(b) by 426 days.

(21) Appl. No.: 12/062,811

(22) Filed: Apr. 4, 2008

(65) Prior Publication Data

US 2009/0250426 A1 Oct. 8, 2009

(51) Int. Cl.
*B65D 39/08* (2006.01)

(52) U.S. Cl. ..... 215/356

(58) Field of Classification Search ..... 215/356, 215/355, 354, 344, 343, 341, 296, 295, 283, 215/280, 273, 44, 43, 329, 316, 200; 220/802, 220/801, 798, 797, 796, 789, 780, 293, 288; D9/529, 516, 439, 435; 222/563, 569
See application file for complete search history.

(56) References Cited

U.S. PATENT DOCUMENTS

| | | | | | |
|---|---|---|---|---|---|
| 130,208 | A | | 8/1872 | Frank | |
| 400,434 | A | | 4/1889 | Bunnell | |
| 1,415,908 | A | | 5/1922 | Tofting | |
| 2,026,304 | A | | 12/1935 | Deady | |
| 2,341,102 | A | | 2/1944 | Kanzaki | |
| 2,609,955 | A | | 9/1952 | Moore | |
| 2,962,185 | A | * | 11/1960 | Starr et al. | 220/254.8 |
| 3,017,047 | A | | 1/1962 | Payson et al. | |
| 3,089,603 | A | | 5/1963 | Leslie-Smith | |
| 3,141,586 | A | | 7/1964 | Wetterek | |
| 3,245,569 | A | | 4/1966 | Essich | |
| 3,269,576 | A | | 8/1966 | Law | |
| 3,476,278 | A | | 11/1969 | Lollmann | |
| 3,733,771 | A | | 5/1973 | Megowen | |
| 3,820,675 | A | | 6/1974 | Malles | |
| 3,944,104 | A | * | 3/1976 | Watson et al. | 215/307 |
| 4,393,976 | A | * | 7/1983 | Maguire | 215/211 |
| 4,645,096 | A | | 2/1987 | Grant | |
| 4,671,421 | A | | 6/1987 | Reiber et al. | |
| 4,711,365 | A | * | 12/1987 | Fomby | 220/288 |
| 4,785,963 | A | | 11/1988 | Magley | |
| 4,892,126 | A | | 1/1990 | Bucheler et al. | |
| 4,917,269 | A | | 4/1990 | Fuchs et al. | |
| 5,005,717 | A | | 4/1991 | Oilar | |
| 5,020,692 | A | | 6/1991 | Darr | |
| 5,060,827 | A | | 10/1991 | Segati | |
| 5,075,951 | A | | 12/1991 | Schurr et al. | |
| 5,207,341 | A | | 5/1993 | Yeager | |
| 5,356,030 | A | | 10/1994 | Budenbender | |
| 5,437,387 | A | | 8/1995 | Burns | |
| 5,597,090 | A | | 1/1997 | Leahy | |
| 5,678,719 | A | | 10/1997 | Adams et al. | |
| 5,709,313 | A | | 1/1998 | Richoux et al. | |
| 5,909,820 | A | | 6/1999 | Yeh | |

(Continued)

*Primary Examiner* — Anthony Stashick
*Assistant Examiner* — Robert J Hicks
(74) *Attorney, Agent, or Firm* — Banner & Witcoff, Ltd.

(57) ABSTRACT

A plug-type closure for use with internally threaded containers. The container includes a container body and a neck defining an internal thread. The closure includes a cap body having an annular wall extending outwardly from the cap body, configured to shroud the neck of the container. The closure further includes a generally cylindrical plug body operatively attached to and extending outwardly from the cap body. The plug body includes a thread that engages with the corresponding internal thread of the container neck to provide a leak-resistant seal.

19 Claims, 6 Drawing Sheets

U.S. PATENT DOCUMENTS 5,947,310 A 9/1999 Wagner
5,971,189 A 10/1999 Baughman
6,032,829 A * 3/2000 Geisinger et al. ..... 222/111
6,102,224 A * 8/2000 Sun et al. ..... 215/252
6,102,225 A 8/2000 Lynn
6,216,897 B1 4/2001 Wagner
6,398,050 B1 6/2002 Allora
6,500,380 B1 12/2002 Geisinger
6,672,817 B2 1/2004 Denny
6,915,920 B2 7/2005 Hwang et al.
7,032,768 B2 4/2006 Felbaum
7,198,169 B2 4/2007 Silk
7,267,250 B2 9/2007 Rudduck et al.
7,287,662 B2 10/2007 Van De Klippe et al.
7,329,041 B2 2/2008 Nottingham et al.
2002/0011498 A1 1/2002 Giblin et al.
2002/0096519 A1 7/2002 Joost et al.
2004/0124192 A1 7/2004 Teller
2005/0211661 A1 9/2005 Galownia et al.
2006/0151422 A1 7/2006 Manley
2008/0017642 A1 1/2008 King

* cited by examiner

CONTAINER CLOSURE WITH INTERNAL THREADING SYSTEM

FIELD OF THE INVENTION

This invention relates generally to closures or stoppers for containers, and more specifically to closures for beverage containers.

BACKGROUND

Many types of container closures exist for glass and plastic bottles. One type of bottle closure is a metal cap, which is crimped onto the top of a glass bottle and requires a bottle opener to remove it. Another type of bottle closure is a cap that screws onto the neck of a bottle. These caps include internal threads that mate with external threads on the neck of the bottle. Generally, these bottle caps seal the opening of a bottle by coming into contact with the top of the bottle neck and covering the opening of the bottle.

It is known that some screw-on bottle closures are made of a unitary construction. It is further known that other types of screw-on bottle closures include a spout containing an orifice for dispensing liquid. The spout may be pulled away from the closure to open the orifice, or the spout may be rotated upwards to open the orifice. The screw-on closures may also include a detachable tamper-evident ring. The above-mentioned bottle closures may be single use or reusable.

SUMMARY OF THE INVENTION

One exemplary aspect of the invention is a novel plug-type closure having external threads for use with a corresponding container having internal threads. The closure may include a cap body and an annular wall extending outwardly from the cap body. The annular wall may be configured to shroud an outside surface of a container neck, to protect, and prevent contamination of, that container neck and of the contents inside a container. The closure may include a plug body formed integral with or operatively attached to the cap body. The plug body may include external threads adjacent the cap body which may extend downwardly on the plug body. The external threads of the plug body are configured to mate with corresponding internal threads of a container neck, thereby providing a leak-resistant seal between the closure and an internally threaded container.

Another aspect of the invention is the combination of the above plug-type closure and a container having internal threads in the container neck. The container may include a container body and a neck terminating in an opening. The internal threads in the container neck may be adjacent the opening of the container and may extend into the container. The internal container threads are capable of engaging the external threads of the plug body and providing a leak-resistant seal between the closure and the container. The container may include external threads configured to mate with the annular wall of the closure, providing a secondary seal and further protecting contamination of the container and its contents.

The invention has several advantages over known closures, including the efficient use of material, which reduces manufacturing costs. The invention also allows for light weight finishes and efficient use of finish material. The corresponding bottle or container may also be constructed of a light weight material, further reducing material costs.

Other features and advantages of the invention will become apparent to those skilled in the art upon review of the following detailed description, claims and drawings in which like numerals are used to designate like features.

Figure 1:
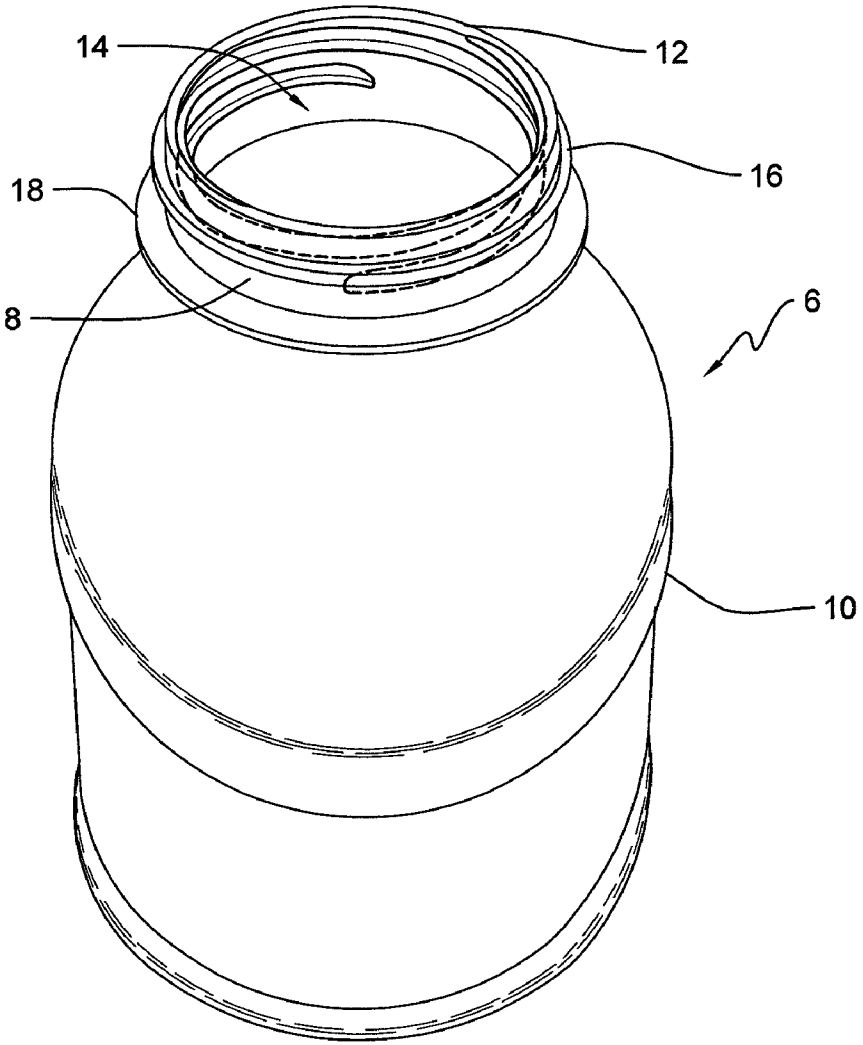
FIG. 1 is a partial side view of a container and depicting the neck and a portion of the body of the container.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

The invention may be embodied in many forms. FIG. 1 illustrates a portion of a container 6 that may define a neck 8 and a container body 10. The neck 8 may further define a top end 12 forming an opening 14. The container 6 may define one or more external rings 16.

Figure 2:
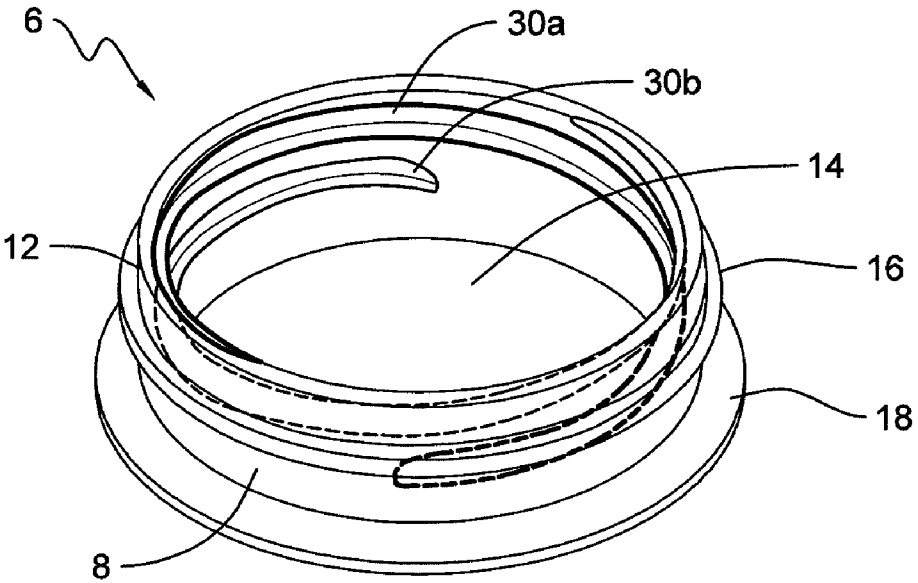
FIG. 2 is an isometric view of the container neck illustrating the internal threads and external threads on the neck of the container.

Referring to FIG. 2, which depicts a cross-sectional view of the container neck 8, an internal thread 30 may be configured within the opening 14 of the neck 8. The internal thread 30 may be configured to receive the closure of the invention, as described below. The internal thread 30 may start at the top end 12 and extend into the container neck 8 any desired distance. The container 6 may be made of any suitable material for containing a beverage, including glass or plastic.

Figure 3:
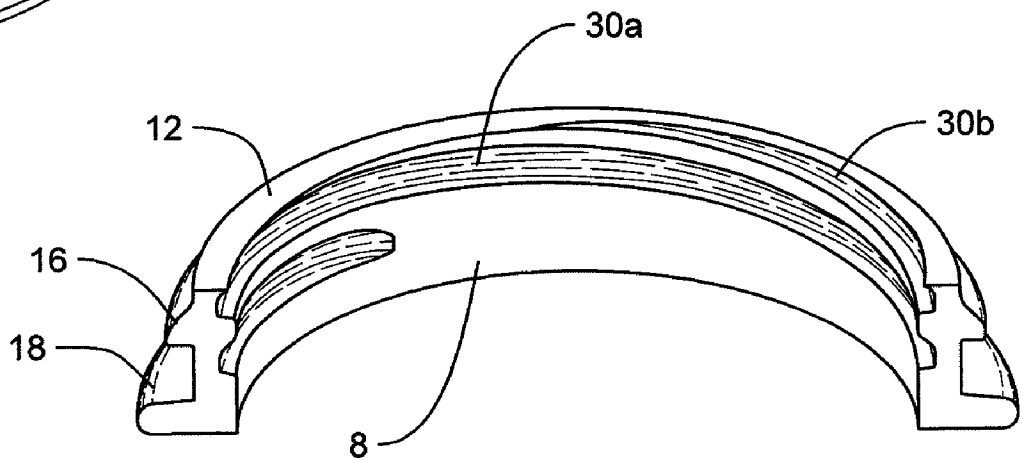
FIG. 3 is an isometric cross-sectional view further illustrating the container neck.

As illustrated in FIGS. 2 and 3, the neck 8 may include a plurality of internal threads 30*a*, 30*b*. The plurality of internal threads 30*a*, 30*b* may start at the top end 12 and extend into the container neck 8 any desired distance. The neck 8 may include one or more external rings 16 on an outer surface of the neck 8. The neck 8 may further include an external ledge 18, which may aid in preventing fluid from the container 6 from dripping down the outer surface of the container 6.

Figure 4:
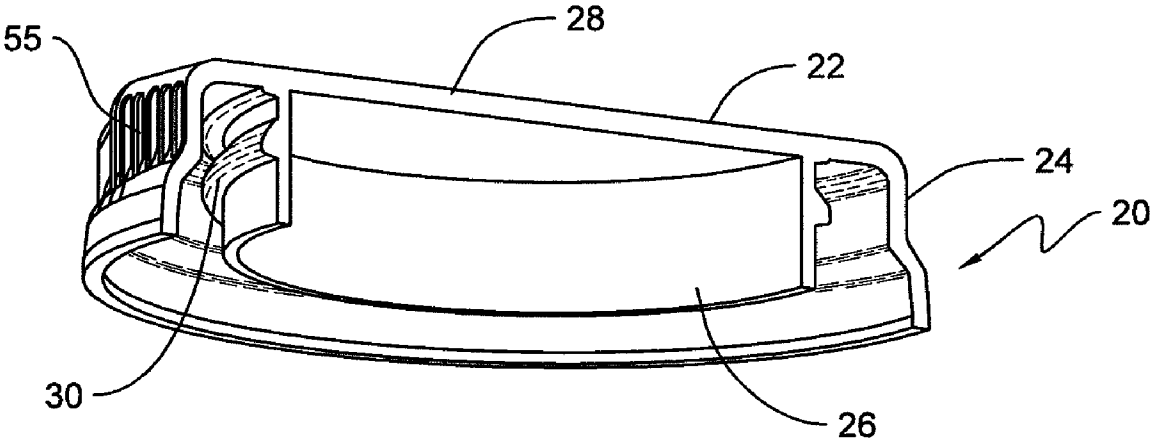
FIG. 4 is an isometric cross-sectional view of an exemplary closure.

Referring to FIG. 4, illustrating a cross-sectional view of an exemplary closure 20, the closure 20 may include a cap body 22, an annular wall 24 extending from the cap body 22, and an annular plug body 26 concentrically positioned inward of the annular wall 24 and extending from the cap body 22. The cap body 22 may define a generally planar inner surface 28 configured to abut the top end 12 of the container 6. The wall 24 may define other suitable configurations other than an annular configuration.

Figure 5:
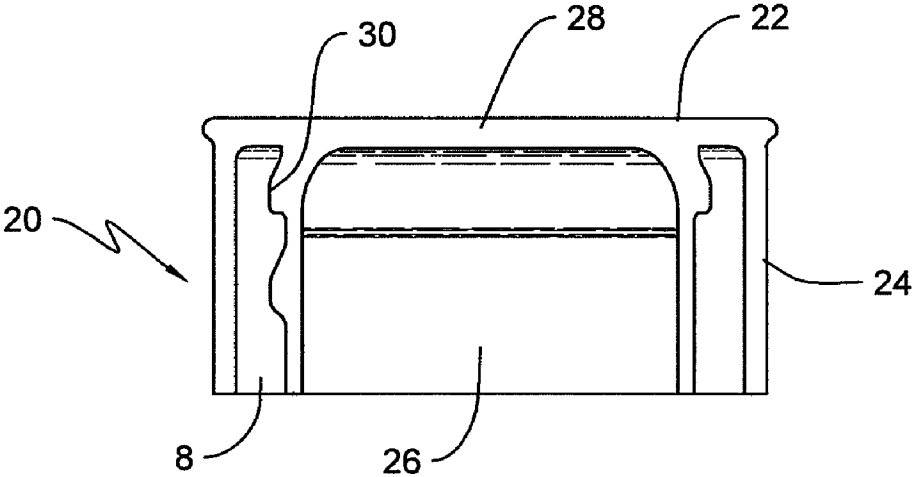
FIG. 5 is a cross-sectional side view of the closure illustrating one embodiment of the plug body.

The plug body 26 may encompass different configurations. For example, as shown in FIG. 5, illustrating the plug body 26, closure 20, and container neck 8, the plug body 26 may be a solid piece of material. Alternatively, the plug body 26 may be hollow, or the plug body 26 may be a concentric ring extending outwardly from the generally planar inner surface 28 of the cap body 22, as depicted in FIG. 4.

Figure 6:
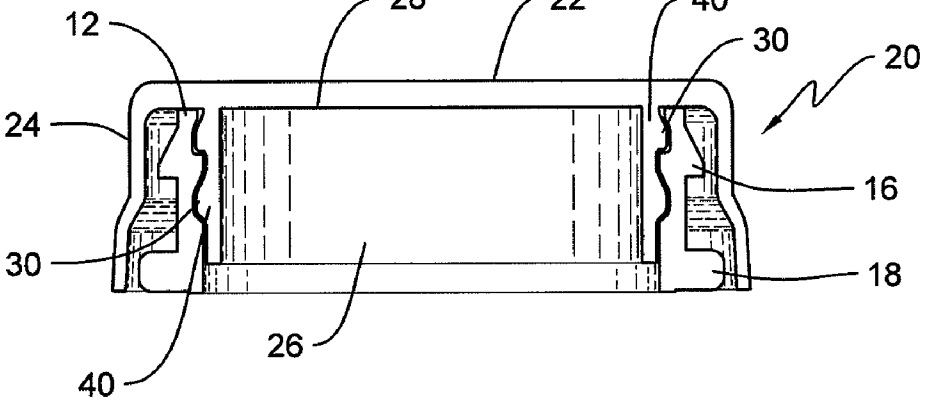
FIG. 6 is a cross-sectional side view of the closure illustrating an alternative embodiment of the plug body.
Figure 10:
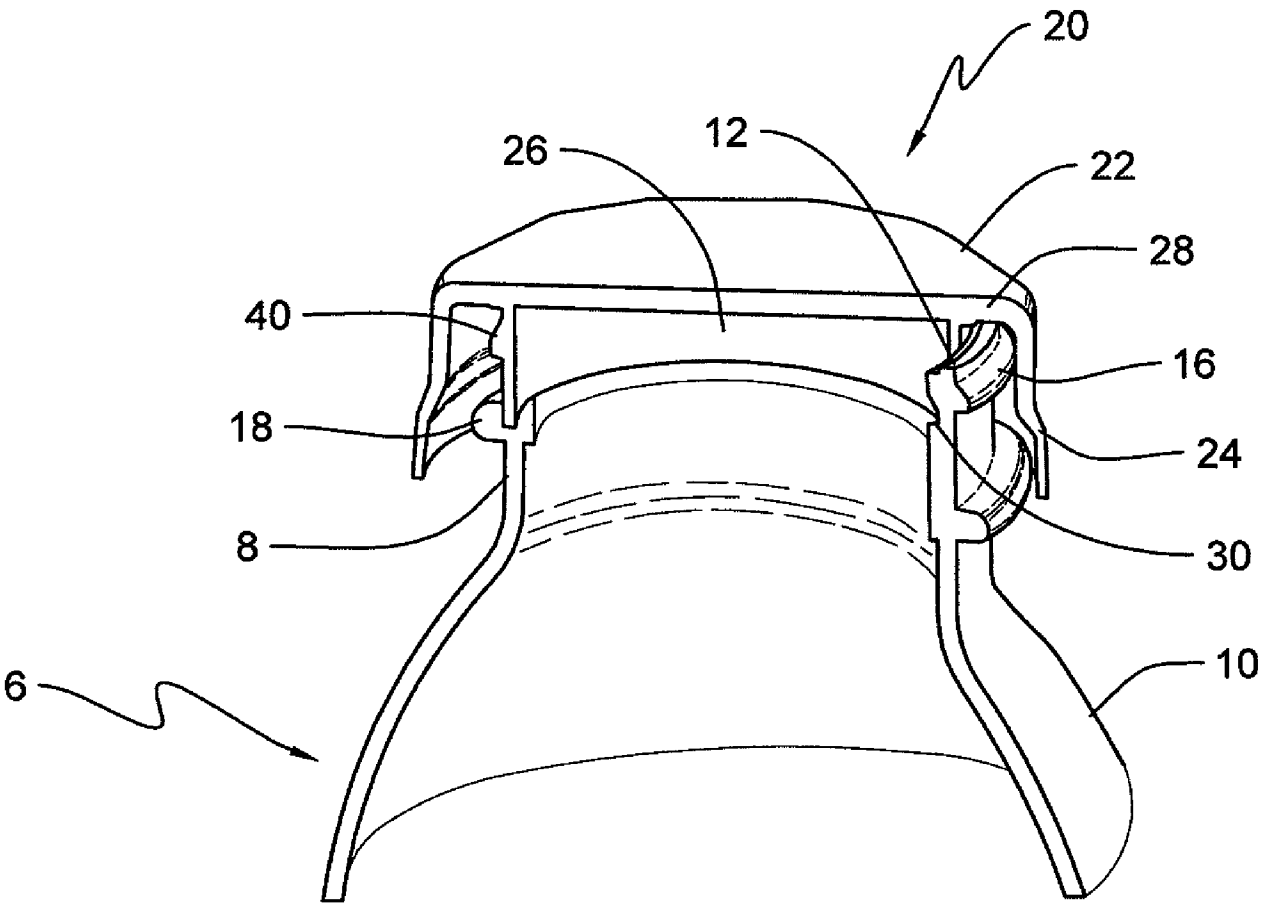
FIG. 10 is a cross-sectional side view of the closure engaged with the container.

The closure 20 may be positioned onto the container body 10 as illustrated in FIG. 10 depicting a cross-sectional view of a partial container 6 and a cross-sectional view of a closure 20. Referring to FIG. 6, showing a cross-sectional view of the container neck 8 and the closure 20, the annular wall 24 of the closure 20 may be positioned near the edges of the cap body 22 and extend outwardly any desired distance so as to cover the opening 14 and neck 8 of the container 6 once the closure 20 is threaded to container 6 and to shroud the outer surface of the neck 8. The annular wall 24 may protect the neck 8 of the container 6 and further prevent contaminants from entering the opening 14. The annular wall 24 may contact or abut a portion of the container 6, such as the external ring 16 of the neck 8 or the external ledge of the container 6, to further aid in sealing the container. In an alternative embodiment, the annular wall 24 may contact and engage the outer surface of the neck 8. Alternatively, the annular wall 24 may be spaced apart from the outer surface of the neck 8, as depicted in FIG. 7.

Figure 8:
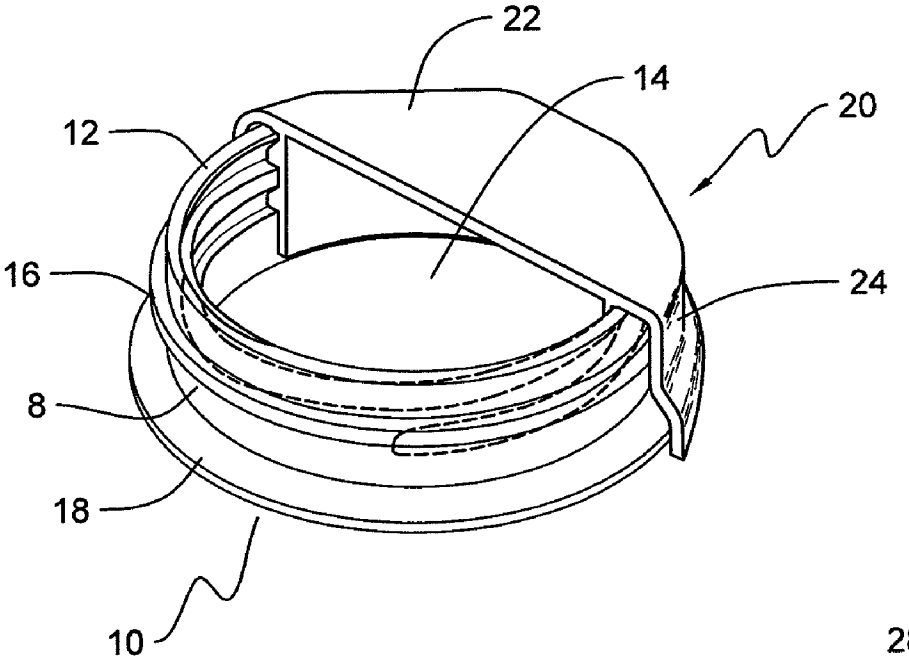
FIG. 8 is an isometric view illustrating the container neck and a partial cross-section of the closure engaged with the container neck.
Figure 9:
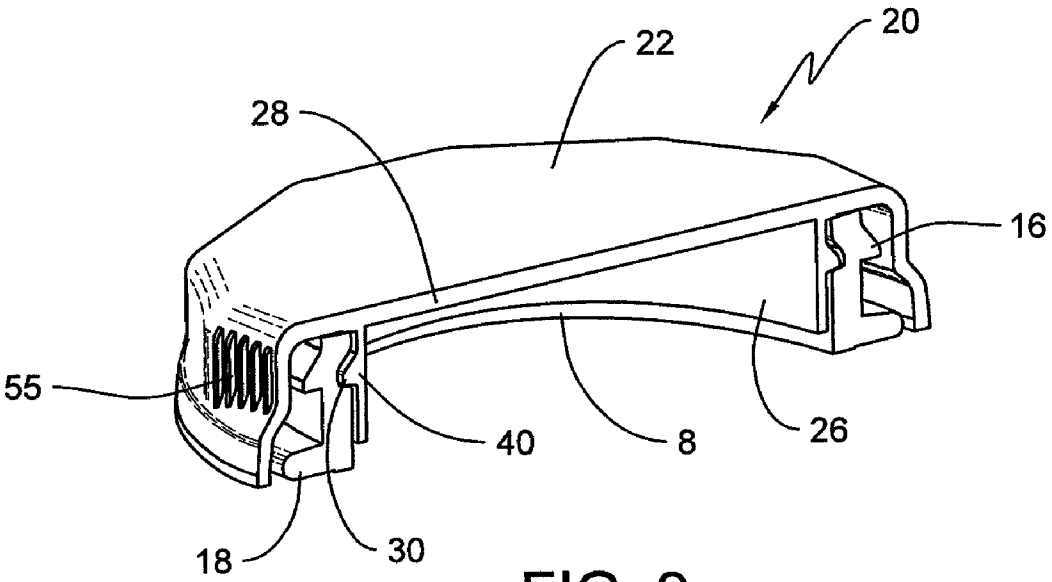
FIG. 9 is an isometric cross-sectional view of the closure shrouding the container neck.

It is contemplated that the outer surface of the annular wall 24 may define any suitable configuration that facilitates the removal of the closure 20 from the container. For example, the outer surface of the annular wall 24 may be smooth, as illustrated in FIG. 8. Alternatively, the outer surface of the annular wall 24 may be textured. The outer surface of the annular wall 24 may also define a plurality of ridges 55, as depicted in FIG. 7, or gripping elements 55, as shown in FIGS. 4, 9, to facilitate the removal of the closure from the container 6. Additionally, a tamper-evident ring, not shown, may be operatively attached to and removable from the bottom edge of the annular wall 24.

Figure 7:
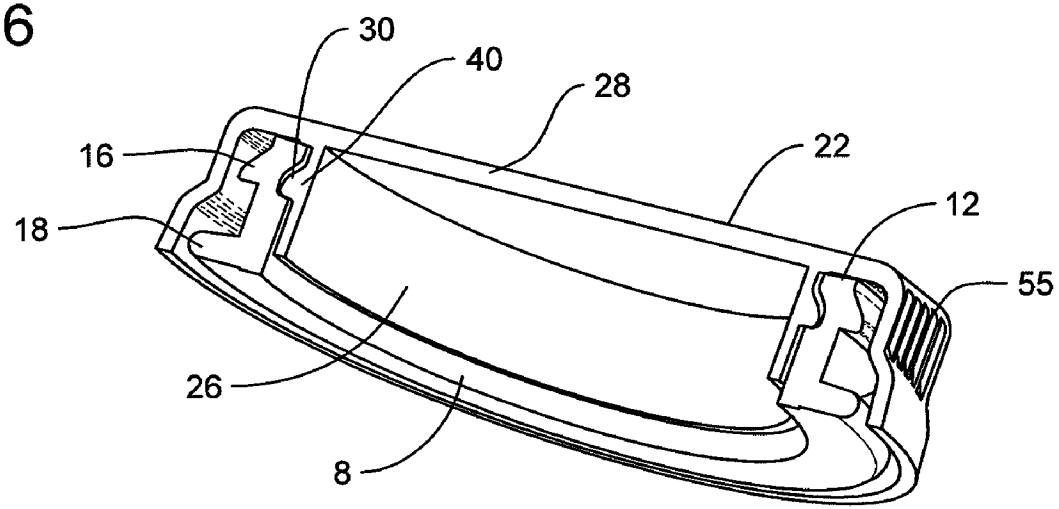
FIG. 7 is an isometric cross sectional view of the closure engaged with the container neck.

As illustrated in FIGS. 5, 6, and 7, the plug body 26 may be generally annular and may extend outwardly from the cap body 22. The plug body 26 may include an external thread 40 positioned on the outer surface of the plug body 26 for engagement with the internal thread 30 of the container 6, as shown in FIGS. 6, 7. The external thread 40 of the plug body 26 may be adjacent the generally planar inner surface 28 of the cap body 22, as illustrated in FIG. 3. The external thread 40 may extend the length of the plug body 26 or may extend a partial distance on the plug body 26. As best illustrated in FIGS. 6, 7, 8, and 9, the engagement of the external thread 40 of the plug body 26 with the internal thread 30 of the container neck 8 creates a leak-resistant seal, thereby preventing fluid from exiting the opening 14 of the container 6, and preventing contaminants from entering the container 6.

In one embodiment, the plug body 26 may be operatively attached to the cap body 22. In another embodiment, the plug body 26 may be formed as a unitary construction with the cap body 22, as well as with the annular wall 24. The closure 20 may be made of any suitable material for use with beverage containers, including materials such as plastic, rubber or the like.

It should be understood that the closure 10 may be used with any type of container 6 in which it is desired to close and seal the opening 14 of the container 6. Consequently, the container 6 and the container body 10, partially depicted in FIGS. 1, 10, may define numerous shapes and configurations, all of which may be used with the invention.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A container and closure assembly, comprising:

a container body defining a neck and an opening in the neck, the neck further defining an internal thread configured within the opening and an outwardly projecting external ledge;

a cap body;

an annular wall extending outwardly from the cap body, the annular wall configured to shroud the neck, the external ledge, and the opening of the container body, the annular wall extending downwardly from the cap body and extending radially past the external ledge; and an annular plug body extending outwardly from the cap body and positioned inward of the annular wall, the plug body defining a thread that is configured to engage with the internal thread of the neck and to create a seal between the plug body and the neck of the container body.

2. The assembly of claim 1, wherein the annular plug body is concentrically positioned relative to the annular wall.

3. The assembly of claim 1, wherein the cap body defines a planar surface.

4. The assembly of claim 1, wherein the annular wall abuts an outer surface of the container.

5. The assembly of claim 1, wherein the cap body, the annular wall, and the plug body are of a unitary construction.

6. The assembly of claim 1, wherein the thread of the plug body is configured on an outer surface of the plug body.

7. The assembly of claim 1, wherein the container body defines an end, and wherein the internal thread extends from the end and into the container.

8. A container and closure assembly, comprising:

a container body defining a neck and an opening in the neck, the neck further defining an internal thread configured within the opening and an outwardly projecting external ledge;

a cap body;

a wall extending outwardly from the cap body, the wall configured to shroud the neck, external ledge, and opening of the container body, the wall extending downwardly from the cap body and extending radially past the external ledge; and an annular plug body extending outwardly from the cap body and positioned inward of the wall, the plug body defining a thread that is configured to engage with the internal thread of the container body and to create a seal between the plug body and the container body, wherein the wall abuts an outer surface of the container.

9. The assembly of claim 8, wherein the wall of the cap body is annular.

10. The assembly of claim 9, wherein the annular plug body is concentrically positioned relative to the annular wall.

11. The assembly of claim 8, wherein the cap body defines a planar surface.

12. The assembly of claim 8, wherein the cap body, the annular wall, and the plug body are of a unitary construction.

13. The assembly of claim 8, wherein the thread of the plug body is configured on an outer surface of the plug body.

14. The assembly of claim 8, wherein the container body defines an end, and wherein the internal thread extends from the end and into the container.

15. The assembly of claim 8, wherein the container defines a neck, and wherein the internal thread is configured on the neck.

16. A closure comprising:

a cap body;

an annular wall extending outwardly from the cap body, the annular wall configured to shroud a neck of a container and an external ledge projecting outwardly from the neck of the container, the annular wall of said closure extending downwardly from the cap body and extending radially past the external ledge; and an annular plug body extending outwardly from the cap body and positioned inward of the annular wall, the plug body defining an external thread that is configured to engage with an internal thread of the neck of the container and to create a seal between the plug body and a neck of a container, wherein the external thread is adjacent the cap body and extends downwardly on the annular plug body, and wherein the annular wall is spaced apart from an outer surface of the container.

17. The closure of claim 16, wherein the annular plug body is concentrically positioned relative to the annular wall.

18. The closure of claim 16, wherein the cap body defines a planar surface.

19. The closure of claim 16, wherein the cap body, the annular wall, and the plug body are of a unitary construction.

* * * * *